US006051280A

United States Patent [19]

Seitz et al.

[11] Patent Number: 6,051,280

[45] Date of Patent: Apr. 18, 2000

[54] METHOD OF CONTROLLING AN ELECTROSTATIC COATING DEVICE AND AN ELECTROSTATIC COATING SYSTEM

[75] Inventors: Kurt Seitz, Widnau; Markus Hasler, Montlingen; Horst Adams, Gallen, all of Switzerland

[73] Assignee: Wagner International AG, Alstatten, Switzerland

[21] Appl. No.: 09/144,747

[22] Filed: Sep. 1, 1998

[30] Foreign Application Priority Data

Sep. 1, 1997 [DE] Germany ..... 197 38 144

[51] Int. Cl.[7] ..... B05D 1/06

[52] U.S. Cl. ..... 427/475; 427/477; 427/479; 427/483; 427/485

[58] Field of Search ..... 427/8, 475, 479, 427/485, 477, 483; 118/668, 690, 669

[56] References Cited

U.S. PATENT DOCUMENTS

| | | | |
|---|---|---|---|
| 3,607,340 | 9/1971 | Stroupe . | |
| 4,324,812 | 4/1982 | Bentley | 427/8 |
| 4,357,900 | 11/1982 | Buschor | 118/681 |
| 5,506,746 | 4/1996 | Seitz | 361/228 |
| 5,864,239 | 1/1999 | Adams et al. | 324/636 |

FOREIGN PATENT DOCUMENTS

| | | |
|---|---|---|
| 899018 | 3/1999 | European Pat. Off. . |
| 38 22 835 A1 | 3/1990 | Germany . |
| 4406046 | 8/1995 | Germany . |
| 195 02 390 A1 | 1/1996 | Germany . |
| 44 06 046 C2 | 11/1997 | Germany . |
| 59-109268 | 5/1984 | Japan . |

OTHER PUBLICATIONS

"Electrostatic Powder Coating", J.F. Hughes, chapter 4, pp. 91–103, 1984.

JOT, No. 8, 37 Jahrgang–D13194, Aug. 1997.

"Taschenbuch für Lackierbetriebe 1997", Curt R. Vincentz Verlag, Hannover 1996.

"Neue Steuerungssystee für flexible Lackiertechnik", Von Werner Heine, Kopperschmidt–Mueller GmbH & Co. KG, Winnenden, I–Lack, 53 Jahrgang Jan./1985, pp. 13–17.

*Primary Examiner*—Fred J. Parker
*Attorney, Agent, or Firm*—Faegre & Benson LLP

[57] ABSTRACT

The invention refers to a method of controlling a coating device, which discharges a coating medium such as a powder or wet lacquer to a workpiece, in which in accordance with the shape of the workpiece the shape of the cloud of the coating medium discharged is automatically adjusted by changing at least one of the velocity, and the quantity, and the mass flow of the coating medium discharged or shaping air. The invention further refers to a coating installation capable of operating by this method.

13 Claims, 5 Drawing Sheets

METHOD OF CONTROLLING AN ELECTROSTATIC COATING DEVICE AND AN ELECTROSTATIC COATING SYSTEM

BACKGROUND OF THE INVENTION

1. Field of the Invention

The present invention refers to a method of controlling an electrostatic coating device, which sprays a coating medium such as powder or wet lacquer onto a workpiece, using an electrostatic coating system which is capable of operating according to this method.

2. Description of the Related Art

In the conventional electrostatic powder coating facilities, a workpiece passes in the horizontal direction through a coating compartment with vertical slots being provided in the side walls of the coating compartment. Through these slots coating guns spray the coating medium onto the workpiece.

The workpieces to be coated may have different sizes and shapes, they may have small webs, large closed surfaces, hollow spaces, recesses etc. In order to optimize the efficiency when applying the coating medium, i.e. in order to spray as little coating powder or lacquer past the workpiece as possible and to ensure penetration into cavities, the shape of the cloud of the coating medium discharged by a coating gun may be varied. This is usually done by selecting a suitable nozzle, e.g. a slot nozzle, the use of a reflector body or the like. In the prior art, the nozzles are exchanged manually. For exchanging the nozzles, operation of the coating system must be interrupted. This of course requires a lot of time and personnel.

BRIEF SUMMARY OF THE INVENTION

The object of the invention is to provide a method of controlling an electrostatic coating device and a new electrostatic powder coating system in which the shape of the cloud of the coating powder discharged can be varied by the lowest possible effort and can be adapted to the shape of the workpiece.

This object is achieved by a method comprising the features of the respective claims.

The invention utilizes the fact that the shape of the powder cloud may be influenced by variation of the quantity or the speed or the mass flow of the coating medium discharged, so that an automatic adaptation of the shape of the cloud is possible without exchanging the spray nozzle. Furthermore, the shape of the cloud may be influenced by adjusting a special forming or shaping air (air coat).

For this purpose, the speed and/or the quantity and/or mass flow of the coating medium discharged or the shaping air volume flow is measured. The shape of the cloud may be characterized by the quantity and speed and/or the mass flow of the coating medium in connection with the nozzle and possibly the shaping air. Preferably, the workpiece to be coated is also detected and identified automatically.

The coating system according to the invention preferably comprises a measuring means and an actuator means for the coating medium or the shaping air volume flow, as well as a workpiece detection and identification means at the input of the coating compartment.

The workpiece detection and identification means detects the approach of a workpiece to be coated as well as the shape and composition thereof. This may for instance be an optical detection means.

The measuring means and the actuator means are preferably integrated into the coating device or arranged in close proximity thereto. Devices for measuring the powder-mass flow, which are suitable for the purposes of the present invention, are described in the German patents DE-A-4 406 046 and DE-A-196 50 112, which are incorporated by reference.

The invention will now be described by the aid of a preferred embodiment with reference to the drawings:

DETAILED DESCRIPTION

Figure 1:
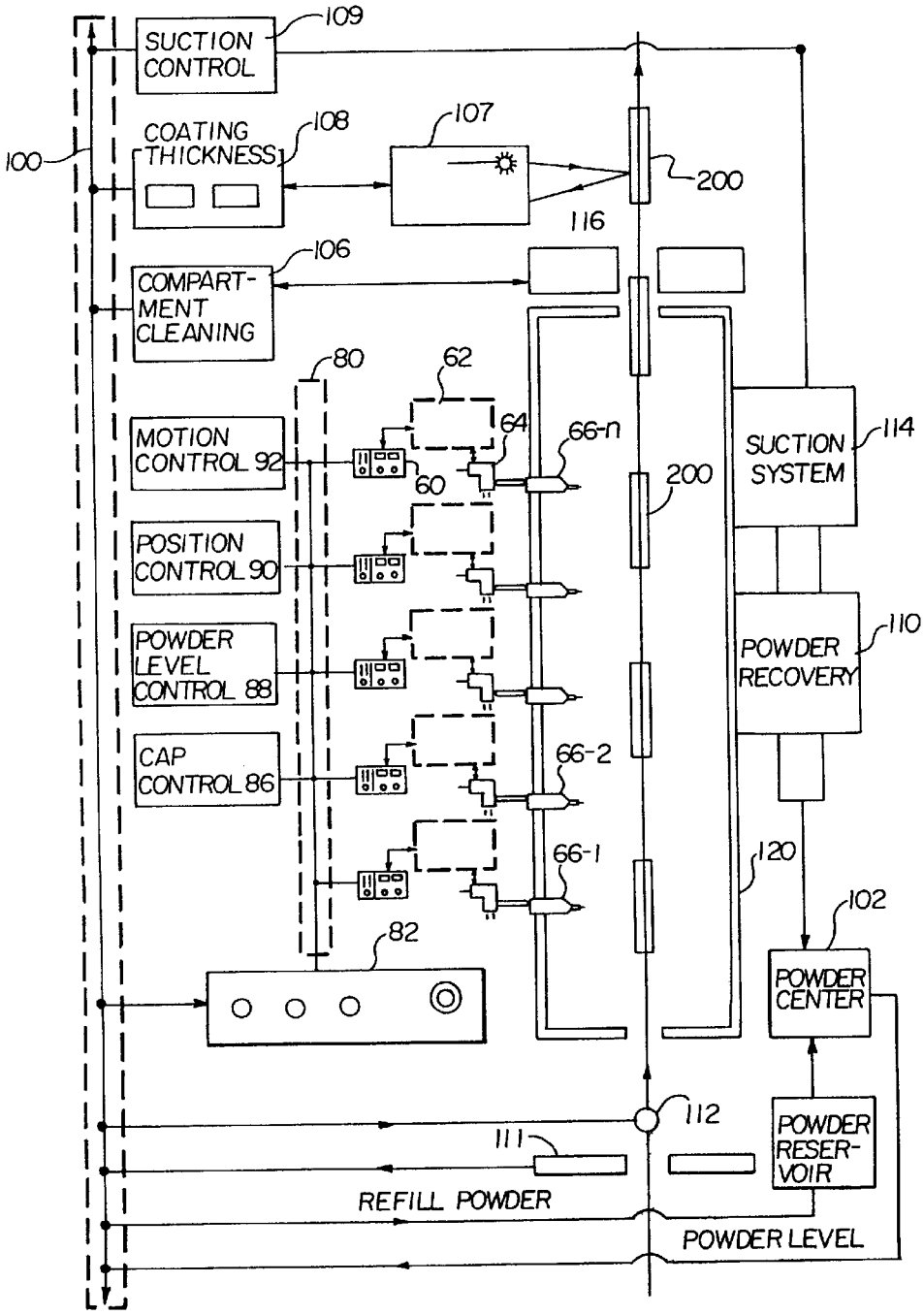
FIG. 1 shows an electrostatic powder coating system according to the invention.

FIG. 1 shows an electrostatic powder coating installation in which the method of controlling the coating devices according to the invention can be used. This powder coating installation is described in more detail in the German patent application DE-A-197 38 141, "Control System for a Coating installation" belonging to the same applicant and having the same filing day and corresponding to the U.S. patent application Ser. No. 09/106,482. The disclosure of this patent application and, in particular the descriptions regarding the network structure, is incorporated herein by reference.

FIG. 1 shows a plurality of (five) coating modules, each consisting of a digital control device 60, an injector actuator means 64, and a spray gun 66, which are connected to one another via a gun bus 62. These coating modules form self-controlling functional units, which receive their respective control signals from the digital control device 60. Information about the operating condition of the coating system, necessary for the control, are received by the control device 60 from an internal bus 80.

The plurality of coating modules are connected to one another, to a central control unit 82 and to further components of the system via the internal bus 80. Additional modules connectable to the internal bus are for instance a gap control module 86, a powder level control module 88, a position control module 90 and a motion control module 92.

The internal bus 80 as well as the gun bus 62 are preferably each LON busses, the digital control units 60 and the modules are configured as LON network nodes and have a LON interface for connection with the LON bus (LON= local area network).

The central control unit 82 supplies the powder coating system with electric power and pressurized air. Furthermore, the control unit can be switched off by this control unit in case of a malfunction.

The gap control module 86 serves for turning off the spray gun in the gaps between the workpieces 200 or parts thereof. The powder level control module 88 monitors the level in a powder reservoir 104. The position control module 90 controls the position of the spray guns in the z-direction, i.e. the distance of the spray gun 66 to the workpiece 200. The motion control module 92 controls the vertical stroke and velocity of the up and down movement of the spray gun in response to the height and velocity of the workpiece 200 to be coated.

Further components may be connected to the central control unit 82 via an external bus 100; these components are for instance a powder center 102 having a powder reservoir 104, a layer thickness measuring and control means 107, 108 and an air quantity control means 109 for a powder recovery system 110, a workpiece detection and identification means 111, a feed clock generator 112, a control means 106 for the compartment cleaning and an associated cleaning means 116 and the like.

The individual components configured as LON nodes, are capable of registering into the system themselves, they are able to detect other system components, adapt thereto and communicate therewith. They may automatically evaluate and use the information about the respective operating conditions of the coating system received via the bus 80 or 100.

Figure 2:
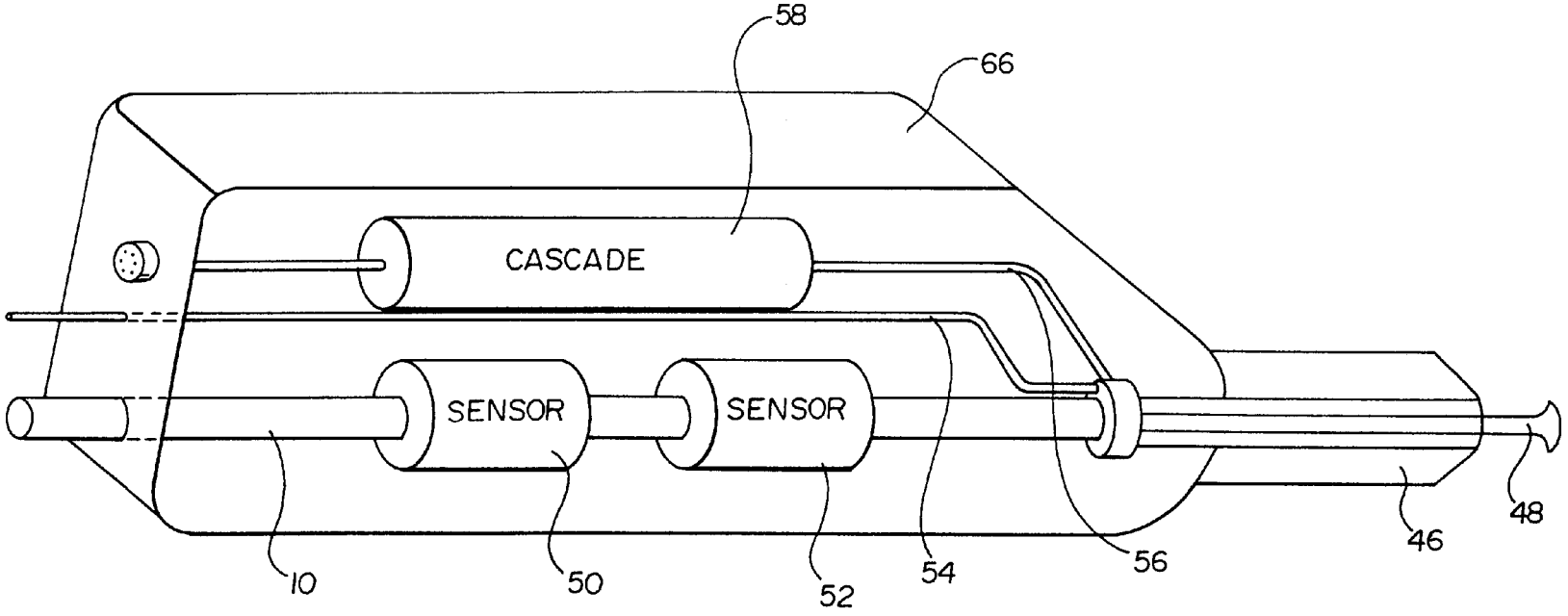
FIG. 2 shows a coating device having an integrated quantity sensor and speed sensor for the powder coating installation according to FIG. 1.

FIG. 2 shows a schematical embodiment of a coating device 66 having an integrated quantity sensor 50, an integrated velocity sensor 52 and an integrated high voltage cascade 58. An adjusted, dosed powder-air-flow is supplied to the coating device 66 via a supply line 10, said flow being discharged at a nozzle 46 having a deflector body 48. A high voltage is generated in a high voltage generator, which is schematically shown as a high voltage cascade 58, and this high voltage is introduced into the powder-air flow via a line 56 and an electrode (not shown) in order to electrically charge the powder particles. FIG. 2 also shows a ground line 54 for connecting the coating device 66 to ground.

The quantity sensor 50 and the velocity sensor 52 serve for determining the powder density and the powder velocity in the supply line 10. They are described in detail below with reference to FIGS. 3 and 4.

Figure 3A:
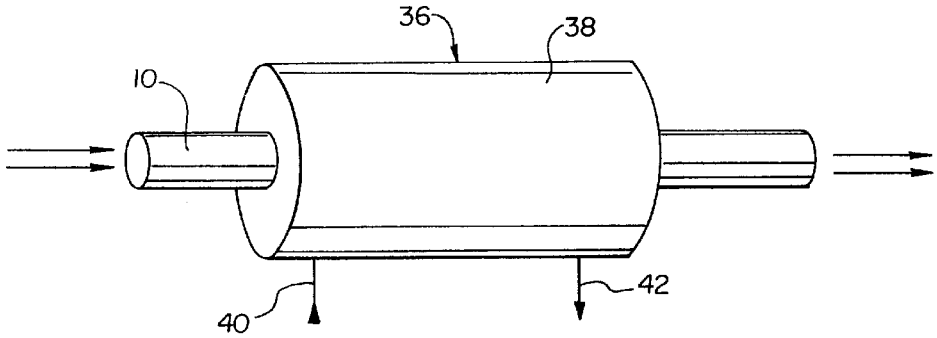
FIGS. 3*a* and 3*b* show an outer view and a schematical partial sectional view of a microwave resonator of the quantity sensor according to FIG. 2.
Figure 3B:
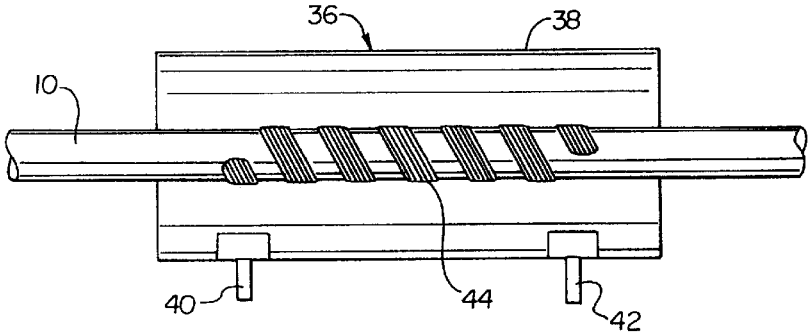

FIGS. 3*a* and 3*b* show an embodiment of a microwave resonator 36 of the powder quantity sensor for determining the powder quantity per volume unit in the supply line 10. The supply line is electrically non-conductive, it is passed by the powder-air-flow in the direction of the arrow in FIG. 3*a*.

The resonator 36 has a metal cylinder 38 for shielding stray fields, with an RF input 40 and a RF output 42 for coupling-in microwaves and for tapping the resonator voltage respectively being provided at the metal cylinder. The resonator 44 is provided in the interior of the shielding cylinder 38 in the form of a helix or coil which is wound around the supply line 10. This resonator requires little space so that it can be directly integrated into the spray gun 66. A precisely limited resonance and therefore a high quality can be achieved by the helical resonator. The helical resonator can e.g. be vacuum-evaporated onto the supply line 10 as a thin film metal layer 44 or a wire helix can be used.

A part of the RF field generated by the resonator penetrates through the wall of the supply line 10 into the powder-air mixture. The resonance frequency of the resonator and its quality are measured. These magnitudes depend on the dielectric constant and on the absorption (the dielectric loss factor) in the resonance volume. The changes of the dielectric constant and the absorption are proportional to the change of the powder quantity in the resonance volume. It results therefrom that a change of the powder quantity in the resonance volume leads to a shift of the resonance frequency and to a change of quality. By measuring the resonance frequency or the quality, a direct conclusion can be made on the powder quantity in the resonance volume. The method for determining the powder mass in the resonance volume is described in more detail in the above mentioned DE-A-44 06 046 and DE-A-196 50 112.

Figure 4:
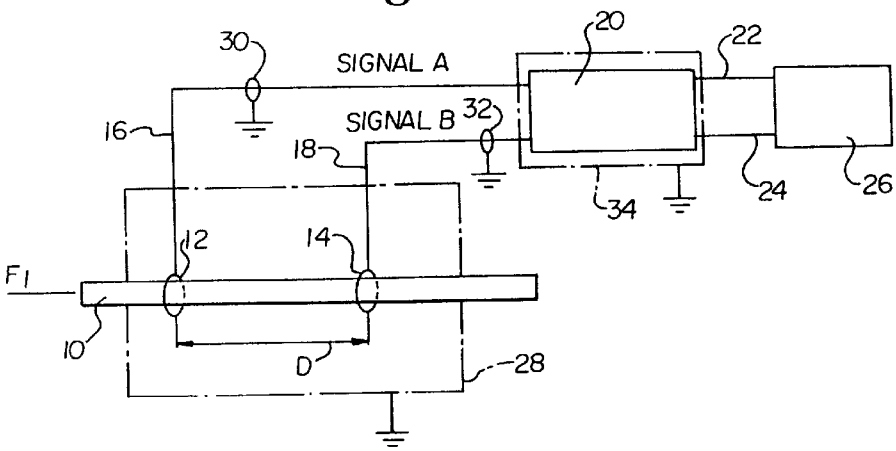
FIG. 4 shows a more detailed view of the speed sensor according to FIG. 2.

FIG. 4 schematically shows the structure of the velocity measuring device. Two measuring electrodes 12, 14 are attached at a distance D at the supply line 10, said measuring electrodes being connected via signal lines 16, 18 and an amplifier 20. The outputs 22, 24 of the amplifier 20 are connected to a measuring value evaluation device 26. The measuring electrodes 12, 14 consist of copper rings, placed around the supply line 10. Furthermore, a grounded shield 28 is placed around the supply line 10 in the measuring area.

The signal line 16, 18 and the amplifier 20 also comprises grounded shields 30, 32 and 34, respectively.

The powder particles of the powder-air flow transported through the plastic line 10 are electrostatically charged by friction with the plastic tube material. These charges influence or induce voltages in the measuring electrodes 12, 14 said voltages being supplied to the measuring amplifier 20. The amplifier measures and amplifies the influence voltages generated by the two electrodes 12, 14. The waveforms of these two signals substantially corresponds (correlation). Since the signal waveforms substantially correspond, a clear definition of the time span between two respective signal peaks is possible so that the velocity v of the powder particles in the supply line 10 can be calculated from the delay $\Delta t$ between the two signal peaks and the distance D between the measuring electrodes: $v=D/\Delta t$.

The velocity measuring method is described in further details in DE-A-44 06 046.

The powder quantity and the powder speed can therefore be determined by means of the above described quantity sensor 50 and the velocity sensor 52 in order to characterize the shape of the cloud of the coating powder discharged. Furthermore, the powder-mass flow of the coating powder can be calculated from the measured velocity and the measured powder quantity as well as from the known dimensions of the supply line, said powder-mass flow also being taken into consideration for characterizing the powder cloud.

The measuring signals are supplied to the digital control device 60 and compared with the target values for the powder quantity and velocity for a workpiece to be coated. Thus, the powder-air flow and thus the desired powder cloud shape can be adjusted via the actuator means shown in FIG. 5.

Figure 5:
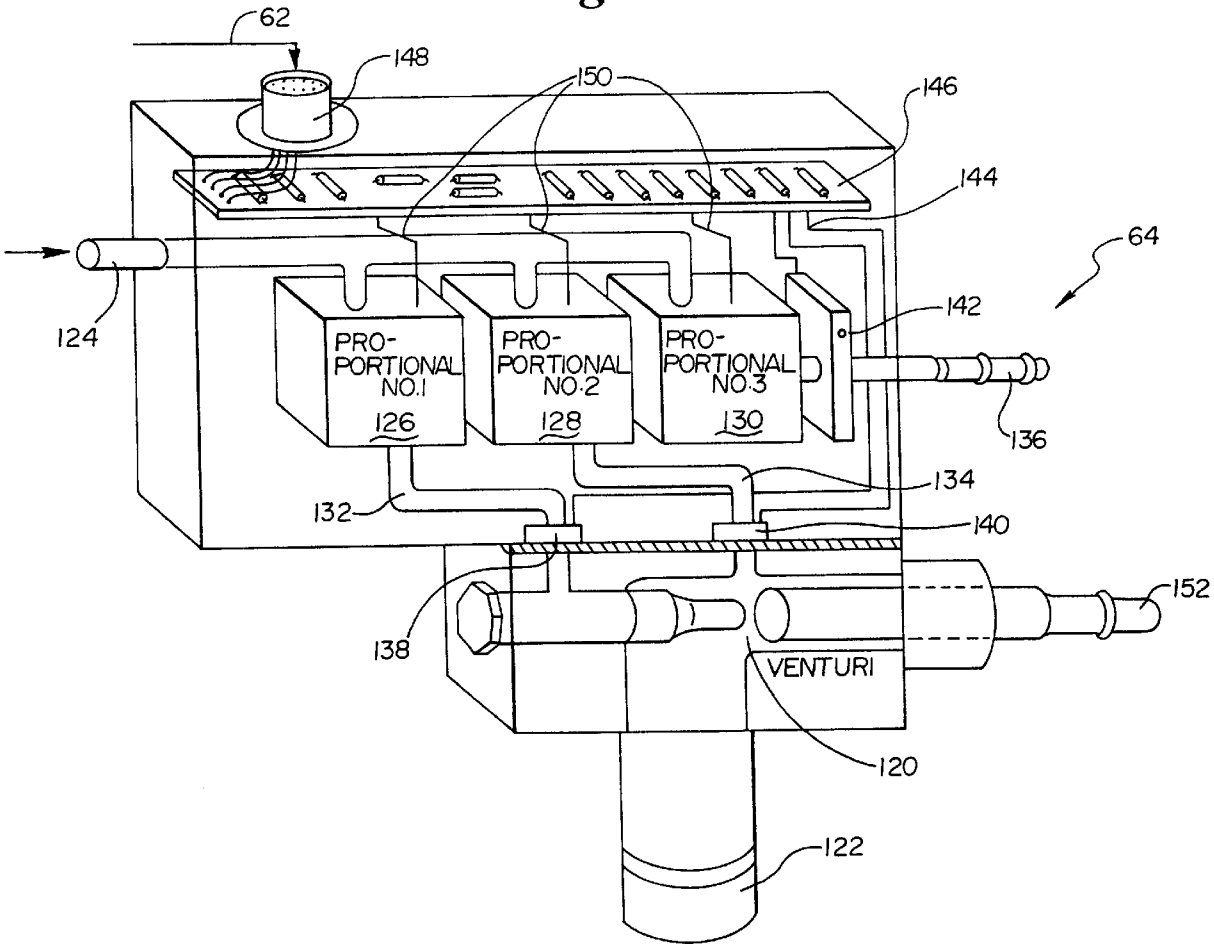
FIG. 5 shows an actuator means for adjusting the shape of the powder cloud according to the invention.

FIG. 5 shows the actuator means 64 for adjusting the powder-air flow, comprising an injector 120, a powder intake line 122, an air supply line 124, a proprortional valve (No. 1) 126 for supply air, which is connected to the injector 120 via a supply air line 132, a proportional valve (No. 2) 128 for dosing air, which is connected to the injector via a dosing air line 134, and a proportional valve (No. 3) 130 for form air, which is directly connected to the spray gun 66 via a shaping air line 136 (FIG. 5). A supply air sensor 138, a dosing air sensor 140 and a shaping air sensor 142 are associated to the supply air line 132, the dosing air line 134 and the shaping air line 136, respectively, in order to measure the respective air volume flows. Signal return lines 144 from the sensors 138, 140 and 142 lead to an interface circuit 146, which is connectable via an adapter 138 to a signal measuring line 62, such as the gun bus. Control measuring lines 150 lead from the interface circuit 146 to the proportional valves 126, 128, 130.

The sensor signals are supplied to the digital control device 60 via the gun bus 62 and compared with the target values for the adjustment of the proportional valves 126, 128 and 130, and respective actuator signals are conducted via the gun bus 62 and the interface circuit 146 to the valves to adjust a desired powder-air flow. If the powder cloud is additionally or exclusively influenced by controlling the shaping air, the signal is evaluated by the shaping air sensor 142 in the control device 60, and in response to the current workpiece shape, a respective actuator signal is sent to the proportional valve No. 3 130.

The output 152 of the injector 120 is connected to the coating device 66 via the supply line 10. In the coating device 66, the velocity and the density of the power-mass flow are detected, as already described. These control signals are returned to the digital control device via the gun bus 62 and used for the control of the powder-air flow.

FIGS. 6*a* to 6*d* show different powder cloud shapes, which are obtained by different nozzles and by different powder-air flows.

Figure 6A:
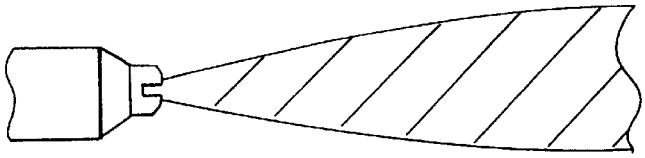
FIGS. 6*a* to 6*d* show different shapes of the powder cloud, which are obtained by different nozzle shapes and powder mass flows.
Figure 6B:
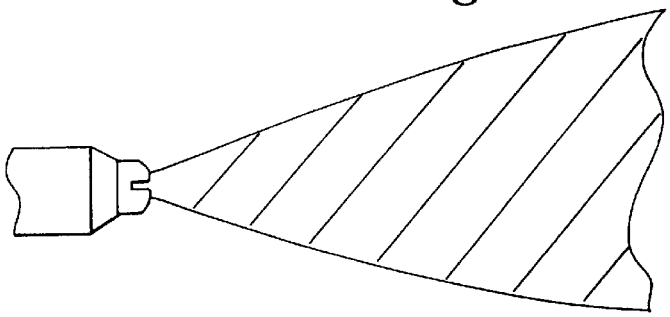
Figure 6C:
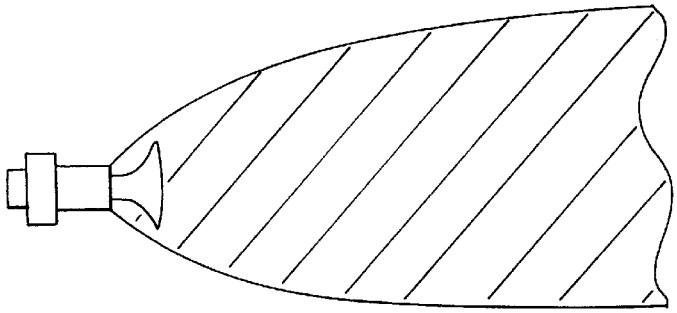
Figure 6D:
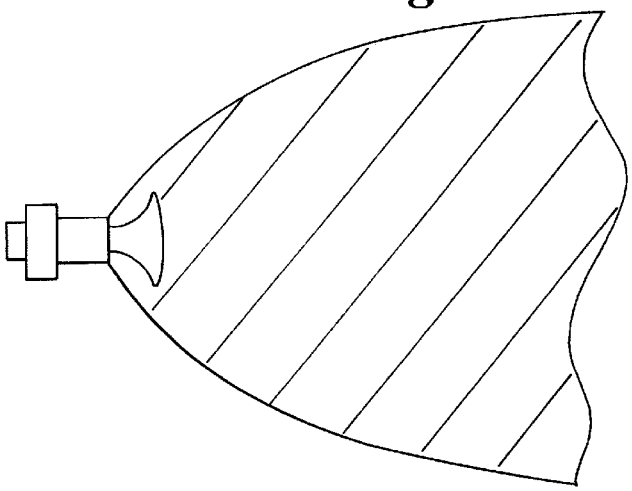

By means of the slot nozzle shown in FIG. 6*a*, a relatively narrow elliptical powder-air jet is obtained, which is narrower and more concentrated at a high powder density and low powder velocity and which is broader at a low powder density and high velocity of the powder-air flow, see FIGS. 6*a* and 6*b*. When using a deflector body, a rounder powder cloud is basically obtained, which is narrower, i.e. more concentrated at a great powder density and low powder velocity, and which is broader at lower powder density and higher velocity of the powder-air flow, see FIGS. 6*c* and 6*d*.

With a given nozzle shape, the powder cloud may be adjusted automatically according to the present invention by varying the powder quantity and/or the powder velocity. In addition, or as an alternative, the cloud shape can be influenced by the separately controlled shaping air.

The features disclosed in the above description, in the claims and in the drawing can be meaningful individually or in any combination for realizing the invention in its various embodiments.

What is claimed is:

1. A method of controlling an electrostatic coating device (66), which discharges an electrostatically charged cloud of a coating medium to a workpiece (200), comprising the steps of detecting the shape of the workpiece; and automatically adjusting a shape of the cloud of coating medium in accordance with the detected shape of the workpiece by controlling:

at least one of the speed and the quantity of the coating medium discharged, and the shaping air flow forming an air coat around the cloud of coating medium discharged by the coating device.

2. A method according to claim 1, characterized in that the speed and the quantity of the coating medium discharged is measured.

3. A method according to claim 1, characterized in that a volume of the shaping air flow is measured.

4. A method according to claim 2, characterized in that a volume of the shaping air flow is measured.

5. A method according to claim 1, characterized in that the shape of the workpiece (200) is detected automatically.

6. The method of claim 1, characterized in that the substeps of controlling of the at least one of the speed and quantity of the coating medium discharged and the shaping air flow are performed by using a digital control device having a bus structure to perform such controlling.

7. The method of claim 6, characterized by providing a plurality of electrostatic coating devices, each forming a network node connected to the bus structure.

8. The method of claim 7, characterized by configuring the network nodes as local area network nodes.

9. The method of claim 6, characterized by providing a workpiece detection means as a network node connected to the bus structure.

10. The method of claim 6, characterized by measuring the velocity of the coating medium discharged using a pair of measuring electrodes attached to a powder supply line and spaced from one another and detecting charge fluctuations at the powder supply line generated by a supplied powder-air mixture by measuring voltage signals and supplying them to a measuring value processing device.

11. The method of claim 6, characterized by measuring mass flow of the coating medium discharged using a radio frequency resonator coupled to a resonance volume to detect fluctuations in a dielectric constant depending upon the powder quantity existing in the resonance volume.

12. The method of claim 6, characterized by measuring mass flow of the coating medium discharged through a supply line by using a radio frequency resonator coupled to the supply line to detect changes in microwave absorption of the powder in the supply line.

13. The method of claim 6, wherein the substep of controlling the shaping air flow is characterized by adjusting the shaping air flow using a proportional valve unit in response to a detected shaping air flow.

* * * * *